US005117991A

United States Patent [19]

Allen

[11] Patent Number: 5,117,991

[45] Date of Patent: Jun. 2, 1992

[54] WINCH SYSTEM

[75] Inventor: John Allen, Gateshead, England

[73] Assignee: Northern Engineering Industries plc, Newcastle upon Tyne, England

[21] Appl. No.: 614,256

[22] Filed: Nov. 16, 1990

[30] Foreign Application Priority Data

Dec. 27, 1989 [GB] United Kingdom ..... 8929195

[51] Int. Cl.[5] ..... B66C 21/00

[52] U.S. Cl. ..... 212/90; 212/91; 254/294; 414/138.4

[58] Field of Search ..... 212/191, 72, 83, 97, 212/99, 90, 91; 254/294, 900; 414/138.2, 138.4

[56] References Cited

U.S. PATENT DOCUMENTS 875,199 12/1907 Miller ..... 212/72

1,053,305 2/1913 Leue ..... 212/72

2,942,740 6/1960 Pristach ..... 414/138.4

FOREIGN PATENT DOCUMENTS 931520 7/1963 United Kingdom ..... 212/72

*Primary Examiner*—Robert J. Spar

*Assistant Examiner*—Janice Krizek

*Attorney, Agent, or Firm*—Cushman, Darby & Cushman

[57] ABSTRACT

The transfer of elongate objects across a gap is enabled by doubling a jackstay between a supply station and a receiving station, so as to provide a pair of parallel guides for the load during transfer. The load is supported from each of the parallel jackstay portions, such that its length is normal to the lengths of the jackstay parallel portions, and moved by outhaul/inhaul cables.

8 Claims, 1 Drawing Sheet

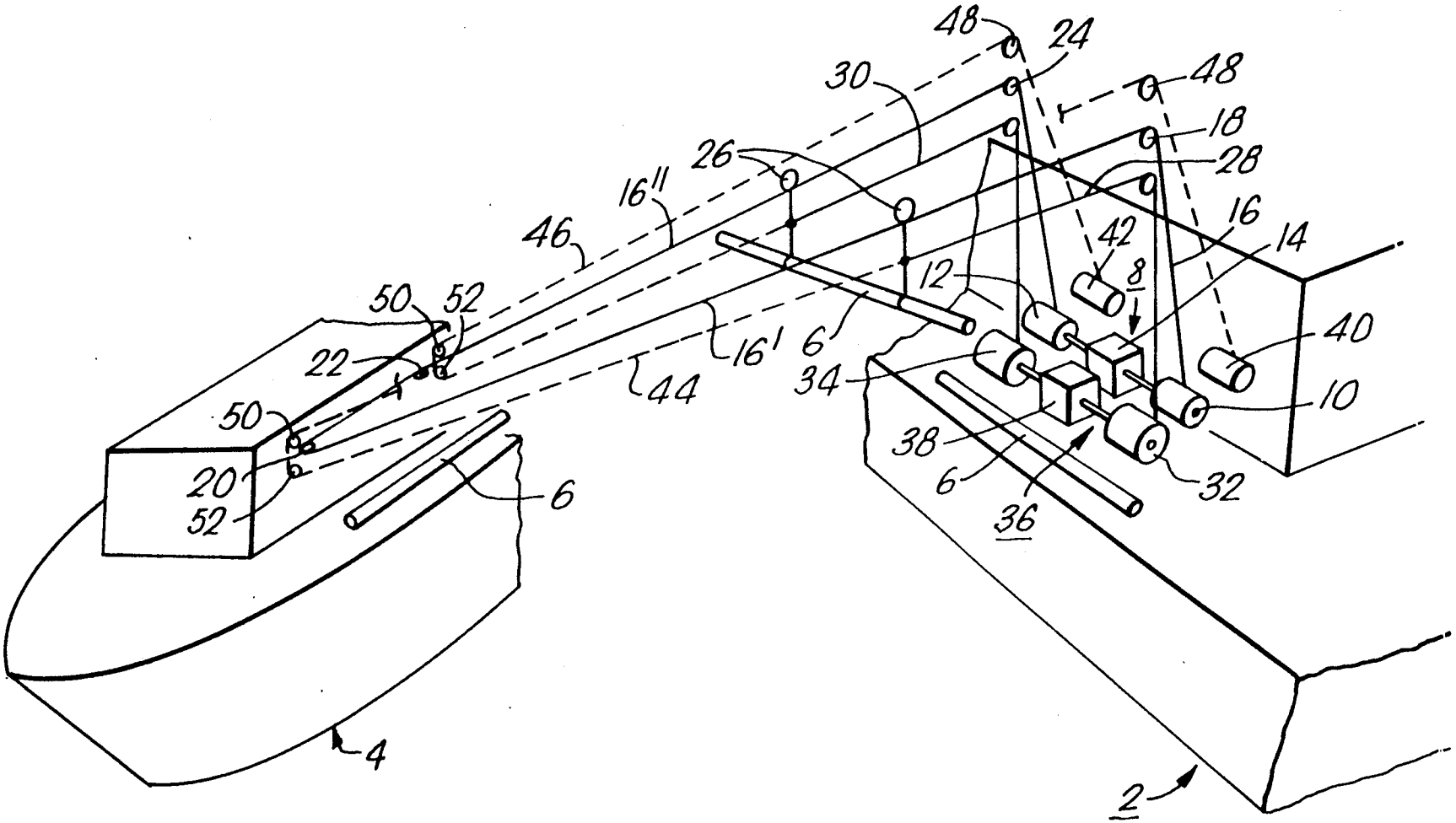
40
10
14
16
28
18
48
32
8
42
24
48
36
12
38
6
30
34
6
26
16'
16''
44
46
6
52
50
4
22
50
20
52
4
2

WINCH SYSTEM

This invention relates to winch systems for hauling payloads between relatively movable stations such as, for example, two ships and has particular application to such systems for handling elongate loads.

Winch systems are known for hauling payloads between a supply ship and a receiving ship, and are described in, for example, United Kingdom specification no. 2130164. The payload is supported on a trolley or pulley block running on a cable extending between the ships and is hauled along the cable by the winch system which comprises an inhaul winch for hauling towards the supply ship and an outhaul winch for hauling towards the receiving ship. Both winches may be on the supply ship or the outhaul winch may be on the receiving ship and the inhaul winch on the supply ship.

Systems such as the above are generally used for transferring relatively compact loads. However, should a load with extended dimensions need to be handled, problems can arise due to excessive swinging of the load either of its relatively large inertia about the suspension point or because a relatively large area of the load is exposed to wind forces.

The problems of handling an elongate object such as, for example, a long thin cylinder using established winch systems can be reduced by suspending the object from two suspension points on a jackstay cable and such that the longitudinal axis of the lifted object extends substantially parallel with the cable. However, such a method requires a large area at the sending end of the system and at the receiving end of the system, considered in the direction of transfer of the object, physically to accommodate the transferred object prior to transfer from the supply ship and subsequent to receipt of the object at the receiving ship.

It would be desirable to be able to provide a winch system capable of transferring elongate payloads between a supply station and a receiving station without undue swinging thereof during transfer and without the necessity for providing significantly increased deck areas at the regions of departure and reception of the payload.

According to the present invention there is provided a winch system for transferring an elongate payload between a supply station and a receiving station, the system comprising a jackstay cable extending from the supply station to the receiving station and back to the supply station thereby providing first and second substantially parallel extents between the two stations the jackstay cable being supplied from a jackstay winch driven to maintain a continuous tension in the jackstay cable, and a pair of support means, one on each extent of the jackstay cable, for suspending therebetween the elongate payload, a pair of inhaul cables extending from associated inhaul winch barrels and connected one to each of the support means, and a pair of outhaul cables extending from associated outhaul winch barrels and connected one to each of the support means.

It will be appreciated that such a system provides a two-point suspension for the payload to locate the payload substantially transversely of the direction of transfer, the jackstay winch being controlled to maintain the same tension along the full length of the jackstay cable—i.e. in both extents—regardless of the attitude of the two stations, which stations may be two ships, a ship and an oil-drilling rig or platform, a semi-submersible and an oil-drilling rig or platform, or the like.

In a preferred embodiment, the opposed ends of the jackstay cable are wound round respective jackstay winch barrels, said barrels conveniently forming parts of a twin-barrel jackstay winch and being driven by a common motor.

Alternatively the jackstay winch may incorporate a single barrel round which one end of the jackstay cable is wound, the other end of the jackstay cable being fixed to the supply station.

Conveniently the system comprises a twin-barrel inhaul winch mounted on the supply station, the two inhaul cables extending one from each of the barrels, which barrels are driven by a common motor.

The outhaul winch barrels may be mounted on the supply station or on the receiving station and may be driven independently of one another. Conveniently, said outhaul winch barrels are subject to automatic tension control to maintain the outhaul cables taut and to permit the action of the inhaul winch barrels to control the positions of the payload support means.

By way of example only, an embodiment of the invention will now be described in greater detail with reference to the accompanying drawing which shows a winch system according to the invention for transferring an elongate payload betweeen a supply ship and a receiving ship.

Referring to the drawing there is shown a supply ship 2 and a receiving ship 4 between which elongate payloads 6, such as torpedoes or lengths of pipe, are to be transferred.

A jackstay winch 8 is mounted on the supply ship 2, said winch including a pair of barrels 10,12 driven by a common motor 14.

A jackstay cable 16 extends from the barrel 10 upwardly over a pulley 18 on the supply ship 2 and across to the receiving ship 4 by way of a first extent 16'. The cable 16 is fed round a pair of horizontally-spaced sheaves 20,22 on the receiving ship 4 and back across to the supply ship 2 by way of a second extent 16" parallel with and spaced from the extent 16'. The cable 16 then passes over a further pulley 24 on the supply ship 2 and down to the barrel 12.

The jackstay winch 8 is operated in automatic mode continually to maintain a tension in the full length of the cable 16, which tension is therefore the same in both the extents 16' and 16", the ends of the cable 16 being wrapped onto the barrels 10 and 12.

Mounted one on each extend 16',16" of the jackstay cable 16 are a pair of support sheaves 26 to which is attached an elongate payload 6 whereby the sheaves 26 can run backwards and forwards along said cable extents 16', 16" and carry the payload between the supply ship 2 and the receiving ship 4. The two load-bearing sheaves 26 may be coupled together by, for example, a mechanical strut or could be entirely independent of one another.

The sheaves 26 together with the payload thereon are tranversed between the two ships 2,4 by means of a pair of inhaul cables 28,30 the ends of which are secured indirectly, one to each sheave 26, said inhaul cables 28,30 extending one from each of the twin barrels 32,34 of a twin-barrelled inhaul winch 36 mounted on the supply ship 2, the barrels 32,34 being driven by a common motor 38.

Also mounted on the supply ship 2 are a pair of outhaul winches having barrels 40,42 from which extend outhaul cables 44,46 respectively, the cables 44,46 each passing over a pulley 48 on the supply ship 2, across to the receiving ship 4, around respective pairs of pulleys 50,52 on the receiving ship 4 and then back towards the supply ship 2 to be connected to an associated one of the sheaves 26, at the same points as cables 28,30.

In a preferred arrangement, the outhaul winches act under automatic tension control to maintain the outhaul cables 44,46 taut and such that control of the position of the payload 6 is effected by appropriate actuation of the twin-barrelled inhaul winch 36 and the inhaul cables 28,30.

In the described system, the continuous loop of jackstay cable 16 connected to the two jackstay barrels 10,12 always maintains the same tension around the loop as a whole so that the load-carrying tension in each cable extent 16',16" is independent of the attitude of the two ships 2,4.

Although the two ships 2,4 move in a substantially parallel manner, as they roll, pitch, heave and yaw under the action of the sea, the continuous loop of jackstay cable 16 automatically adjusts for the fact that the distance between the jackstay barrels 10,12, or the jackstay pulleys 18,24, on the supply ship 2 and the two corresponding points on the receiving ship 4 are not always equal.

This can be compared with an arrangement merely comprising duplication of the known winch systems in which two separate jackstay cables would be provided each terminating in a positive fixing on the receiving ship and whereby, as the ships yawed relative to one another, one of the jackstay cables would sag more than the other and the payload would be caused to oscillate in a vertical plane as the height of the two suspension sheaves on the two jackstay cables changed relative to one another.

Furthermore, coupling together of the two inhaul winch barrels 32,34, rather than simply having a duplication of two independent systems, results in the payload 6 maintaining an attitude parallel with the longitudinal axis of the supply ship 2 regardless of relative movement between the supply ship 2 and the receiving ship 4.

In addition, mechanical coupling of the two barrels 10,12 and the two barrels 32,34 means that there is no need to synchronise two separate drives and control systems to the jackstay winch or the inhaul winch as would be required if two independent single systems were used.

In an alternative arrangement, the jackstay winch 8 may comprise only one barrel around which one end of the jackstay cable 16 is wound, the other end of the jackstay cable being secured relative to the supply ship 2.

The outhaul winch barrels 40,42, which may be on the receiving ship 4 rather than the supply ship 2, may be driven independently either through two separate transmissions or, for example, by a differential split transmission from a common drive. Such modes of operation ensure that both outhaul cables 44,46 are maintained under tension for satisfactory operation of the system regardless of relative displacements between the supply ship 2 and the receiving ship 4.

The means for raising and lowering the payload 6 at the start and finish of the transfer operation would be substantially as with established systems, except that two moving trolleys or padeyes would be provided corresponding to the two load suspension points 26.

Thus there is provided a winch system particularly suited to transferring elongate payloads between two stations and which is such as to ensure that the payload remains in an orientation substantially perpendicular to the direction of transfer of the payload, thus considerably reducing the deck areas at the stations from which the payload is despatched and at which the payload is received, and minimising any undesirable oscillation of the payload during the transfer procedure.

I claim:

1. A winch system for transferring an elongate payload between a supply station and a receiving station, the system comprising a jackstay cable extending from the supply station to the receiving station and back to the supply station so as to provide first and second substantially parallel extents between the two stations, the jackstay cable being supplied from a jackstay winch driven to maintain a continuous tension in the jackstay cable, a pair of payload support means, each one of the pair on a respective extent of the jackstay cable for suspending the elongate payload between the extents, a pair of inhaul cables, each one of the pair extending from a respective inhaul winch barrel and connected payload support means, and a pair of outhaul cables extending from associated outhaul winch barrels and each one of the pair connected to a respective payload support means.

2. A winch system as claimed in claim 1 in which the opposed ends of the jackstay cable are wound round respective jackstay winch barrels.

3. A winch system as claimed in claim 2 in which the jackstay winch barrels form part of a twin-barrel jackstay winch and are driven by a common motor.

4. A winch system as claimed in claim 3 wherein the inhaul winch barrels are mounted on the supply station, and are driven by a common motor.

5. A winch system as claimed in claim 4 in which the outhaul winch barrels are mounted on one of the supply station and the receiving station and are driven independently of one another, to maintain tension in the two respective outhaul cables.

6. A winch system as claimed in claim 5 in which the outhaul winch barrels are subject to automatic tension control to maintain the outhaul cables taut and to permit the action of the inhaul winch barrels to control the positions of the payload support means.

7. A winch system as claimed in claim 4 in which the outhaul winch barrels are mounted on one of the supply station and the receiving station and are driven in such a manner that each outhaul winch barrel of the pair can operate at a different speed to maintain tension in the two respective outhaul cables.

8. A winch system as claimed in claim 7 in which the outhaul winch barrels are subjected to automatic tension control to maintain the outhaul cables taut and to permit the action of the inhaul winch barrels to control the positions of the payload support means.

* * * * *